US006712028B1

(12) United States Patent
Robbins et al.

(10) Patent No.: US 6,712,028 B1
(45) Date of Patent: Mar. 30, 2004

(54) ENGINE COOLING SYSTEM WITH WATER PUMP RECIRCULATION BYPASS CONTROL

(75) Inventors: Joseph E. Robbins, Mayville, MI (US); Chandran B. Santanam, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/397,082

(22) Filed: Mar. 26, 2003

(51) Int. Cl.[7] ..... F01P 7/14

(52) U.S. Cl. ..... 123/41.08; 123/41.44

(58) Field of Search ..... 123/41.08, 41.44, 123/41.1

(56) References Cited

FOREIGN PATENT DOCUMENTS

| | | | | |
|---|---|---|---|---|
| EP | 251214 A | * | 1/1988 | ..... F01M/05/00 |
| JP | 58106125 A | * | 6/1983 | ..... F01P/07/16 |
| JP | 05263642 A | * | 10/1993 | ..... F01P/07/16 |

* cited by examiner

*Primary Examiner*—Noah P. Kamen
(74) *Attorney, Agent, or Firm*—Leslie C. Hodges

(57) ABSTRACT

A cooling system has a system bypass to reduce parasitic losses in an internal combustion engine. The system bypass has a diverter valve actuated by a control module to selectively control the amount of coolant flow through the engine without regard to the speed of the water pump. As less coolant is needed to cool the engine, the diverter valve directs more coolant through the bypass to be recirculated to the water pump. The energy absorbed by the water pump is reduced by the reduced coolant flow, which increases the efficiency of the system and reduces engine parasitic losses.

3 Claims, 1 Drawing Sheet

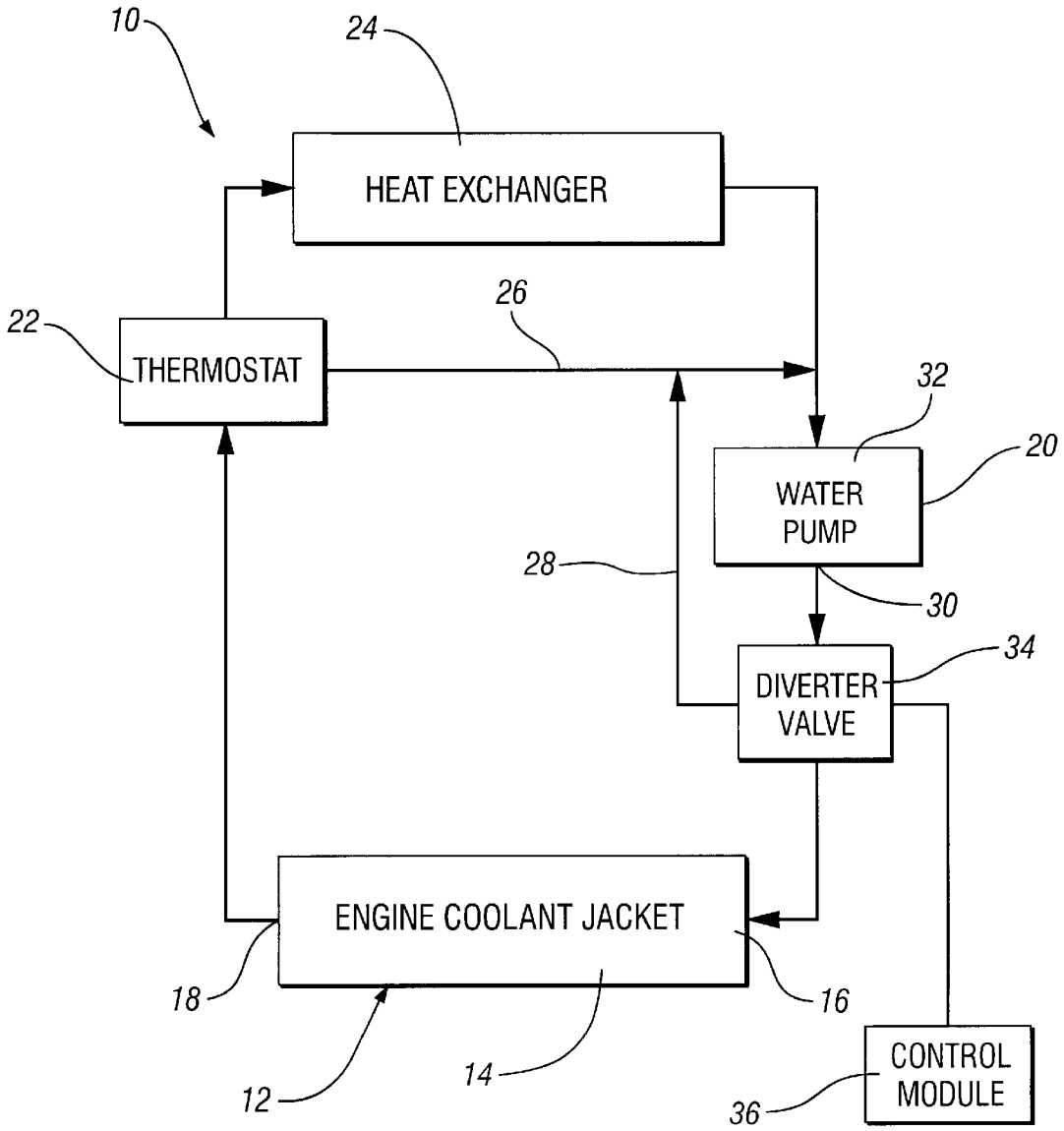
10
24
HEAT EXCHANGER
22
THERMOSTAT
26
32
20
WATER PUMP
28
30
34
DIVERTER VALVE
ENGINE COOLANT JACKET
18
16
12
14
CONTROL MODULE
36

ENGINE COOLING SYSTEM WITH WATER PUMP RECIRCULATION BYPASS CONTROL

TECHNICAL FIELD

This invention relates to a cooling system for a liquid cooled internal combustion engine and more particularly to a system including a bypass for controlling coolant flow through the system.

BACKGROUND OF THE INVENTION

Commonly, a pressurized cooling system employs a circulating liquid coolant for cooling an internal combustion engine, including both gasoline and diesel fueled engines. Engine heat is transferred from the engine to the coolant through a coolant jacket surrounding certain parts of the engine. The heat absorbed by the circulated coolant is dissipated by a heat exchanger, generally by a radiator, into the air.

Under most normal operating conditions, an engine only requires nominal coolant flow to maintain proper temperature of internal components. However, under severe conditions, an engine requires increased coolant flow to maintain proper temperature of internal components. If a high flow rate water pump is used to provide a high coolant flow rate under severe conditions to prevent engine overheating, the amount of coolant flow will be excessive under normal operating conditions. Parasitic losses occur in a cooling system having excessive coolant flow through the engine.

SUMMARY OF THE INVENTION

The present invention minimizes parasitic losses in a cooling system by using a system bypass to reduce coolant flow through the coolant jacket of an engine. The system bypass allows coolant to bypass the engine and flow directly from the outlet of the water pump in to the inlet of the water pump, thereby forming a recirculating loop. A diverter valve in the system bypass can selectively increase or decrease coolant flow through engine coolant jacket without changing the output of the water pump.

A control module detects coolant temperature, fuel flow rate, air flow rate, and engine knock information. As these values change, the control module adjusts the diverter valve accordingly to maintain proper engine cooling. The control module actuates the diverter to recirculate a greater amount of coolant flow to the water pump, when the engine is operating below optimal temperature. As the engine reaches optimal operating temperature, a conventional thermostat directs engine coolant flow to a radiator to maintain a desired coolant temperature. The control module actuates the diverter to control coolant flow between the system bypass and the coolant jacket of the engine to maintain needed coolant flow.

Under severe conditions such as high speed driving, rapid acceleration, or towing, additional engine heat is produced. As a result of the additional heat production, the control module actuates the diverter valve to increase coolant flow to the coolant jacket to maintain optimal engine operating conditions. As conditions change where engine heat production is reduced, the control module actuates the diverter valve to divert additional coolant to the system bypass instead of the coolant jacket to increase cooling system efficiency and thereby reduce parasitic losses in the system.

These and other features and advantages of the invention will be more fully understood from the following description of certain specific embodiments of the invention taken together with the accompanying drawings.

BRIEF DESCRIPTION OF THE DRAWINGS

The single drawing FIGURE is a diagrammatic view of an engine cooling system according to the present invention.

DESCRIPTION OF THE PREFERRED EMBODIMENT

Referring to the single drawing FIGURE in detail, numeral 10 generally indicates a cooling system for an internal combustion engine. System 10 includes an engine 12 having a coolant jacket 14. The coolant jacket 14 includes an inlet 16 and an outlet 18. The inlet 16 is connected to receive coolant from an engine driven water pump 20 which operates at a rotational speed that varies with engine rpm. The outlet 18 is connected through a thermostat with a radiator or ambient air heat exchanger 24 for removing excess heat from the coolant heated in the engine. Coolant discharged from the radiator 24 is conducted back to the water pump to be recirculated through the system 10 for cooling the engine 12.

To maintain a desired engine coolant temperature, the thermostat 22 regulates the amount of coolant flow to the radiator 24 by directing excess coolant flow back to the water pump 20 through a radiator bypass line 26 to avoid over cooling the engine. During engine warm-up, coolant flow through the radiator is completely cut off until a desired engine out coolant temperature is reached.

Because the water pump 20 is engine driven, it must be designed to provide adequate coolant flow at idle as well as at maximum engine loads over the engine speed range. As a result, the coolant flow at higher speeds and lower loads is generally greater than is needed to cool the engine 12. Thus, a large amount of coolant is caused to bypass the radiator 24 in order to maintain the desired coolant temperature out of the engine 12. The excess coolant flow in the system 10 and through the engine results in parasitic power losses that reduce system efficiency.

In accordance with the present invention, the system 10 includes a system bypass line 28 that connects the water pump outlet 30 directly to the water pump inlet 32. A diverter valve 34 is connected to the system bypass line 28 between the water pump outlet 30 and the engine coolant jacket inlet 16 to selectively regulate the amount of coolant flow recirculated back to the water pump 20.

The system bypass 28 allows the water pump 20 to operate at a reduced pressure differential by reducing the flow of coolant through the engine coolant jacket 14, which has a higher flow resistance than the system bypass 28. Thus, as the amount of coolant pumped through the coolant jacket 14 decreases, the energy required to drive the water pump decreases and efficiency of the cooling system increases.

A control module 48 detects coolant temperature, fuel flow rate, air flow rate, and engine knock information. The control module uses this information to adjust the position of the diverter valve 44 to provide adequate coolant flow to the coolant jacket 14 of the engine 12.

In operation, engine coolant flows from the water pump 20 to the coolant jacket 14 of the engine 12. The diverter valve 34 diverts some of the coolant through the system bypass line 28 to the inlet of the water pump. This reduces the flow of coolant through the engine coolant jacket 14 without reducing the speed of the water pump 20.

The coolant not diverted into the system bypass 28 flows through the engine coolant jacket 14. Coolant from the engine 12 is directed to the thermostat 22 which directs the coolant to the radiator 24 or through the radiator bypass 26 back to the water pump 20.

Under start up and other low temperature conditions, the thermostat 26 stops coolant flow to the radiator 24, causing the coolant to flow through the radiator bypass 26 to the water pump 20. When the coolant reaches its optimal engine out temperature, the thermostat 26 opens, modulating coolant flow through the radiator 24 to maintain the desired temperature.

The control module 36 monitors coolant temperature, fuel flow rate, air flow rate, and engine knock information. Based upon these factors, the control module 36 determines the appropriate amount of coolant the engine needs to maintain optimal operation temperatures. As the engine develops more heat, the control module 36 actuates the diverter valve 34 to direct more coolant from the water pump 20 to the coolant jacket 14 to increase cooling of the engine 12. As the engine 12 develops less heat, typically under low load conditions, the control module 36 actuates the diverter valve 34 to direct more coolant into the system bypass 46 to increase system efficiency.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. An improved cooling system for a liquid cooled internal combustion engine including a coolant jacket, a water pump having an outlet connected to the coolant jacket, and a heat exchanger with a temperature control valve and bypass connected between the coolant jacket and an inlet of the water pump, the improvement comprising:

a system bypass connecting the outlet to the inlet of the water pump, and a diverter valve in the system bypass operable to selectively control the flow of coolant through the bypass and through the engine coolant jacket; and a control operative to regulate the diverter valve to control engine coolant flow rates, in response to monitored engine coolant temperature and knock information, to reduce parasitic losses by limiting excess coolant flow through the engine while maintaining adequate flow to control coolant temperature and engine knock.

2. An improved cooling system for a liquid cooled internal combustion engine including a coolant jacket, a water pump having an outlet connected to the coolant jacket, and a heat exchanger with a temperature control valve and bypass connected between the coolant jacket and an inlet of the water pump, the improvement comprising:

a system bypass connecting the outlet to the inlet of the water pump and a diverter valve in the system bypass operable to selectively control the flow of coolant through the bypass and through the engine coolant jacket; and a control operative to regulate the diverter valve to control engine coolant flow rates, in response to monitored engine coolant temperature, air flow rate and fuel flow rate, to reduce parasitic losses by limiting excess coolant flow through the engine while maintaining adequate flow to control coolant temperature.

3. An improved cooling system for a liquid cooled internal combustion engine including a coolant jacket, a water pump having an outlet connected to the coolant jacket, and a heat exchanger with a temperature control valve and bypass connected between the coolant jacket and an inlet of the water pump, the improvement comprising:

a system bypass connecting the outlet to the inlet of the water pump and a diverter valve in the system bypass operable to selectively control the flow of coolant through the bypass and through the engine coolant jacket; and a control operative to regulate the diverter valve to control engine coolant flow rates, in response to monitored engine coolant temperature, knock information, air flow rate and fuel flow rate, to reduce parasitic losses by limiting excess coolant flow through the engine while maintaining adequate flow to control coolant temperature and engine knock.

* * * * *